US011087674B2

(12) United States Patent
Chang et al.

(10) Patent No.: US 11,087,674 B2
(45) Date of Patent: Aug. 10, 2021

(54) SUBPIXEL CIRCUITRY FOR DRIVING AN ASSOCIATED LIGHT ELEMENT, AND METHOD, DISPLAY SYSTEM AND ELECTRONIC DEVICE RELATING TO SAME

(71) Applicants: Nanyang Technological University, Singapore (SG); Massachusetts Institute of Technology, Cambridge, MA (US); National University of Singapore, Singapore (SG)

(72) Inventors: Joseph Sylvester Chang, Singapore (SG); Wei Shu, Singapore (SG); Yong Qu, Singapore (SG); Eugene A. Fitzgerald, Cambridge, MA (US); Li Zhang, Singapore (SG); Eng Kian Kenneth Lee, Singapore (SG); Soo Jin Chua, Singapore (SG); Siau Ben Chiah, Singapore (SG)

(73) Assignees: Nanyang Technological University, Singapore (SG); Massachusetts Institute of Technology, Cambridge, MA (US); National University of Singapore, Singapore (SG)

( * ) Notice: Subject to any disclaimer, the term of this patent is extended or adjusted under 35 U.S.C. 154(b) by 0 days.

(21) Appl. No.: 16/486,026

(22) PCT Filed: Feb. 1, 2018

(86) PCT No.: PCT/SG2018/050048
§ 371 (c)(1),
(2) Date: Aug. 14, 2019

(87) PCT Pub. No.: WO2018/151673
PCT Pub. Date: Aug. 23, 2018

(65) Prior Publication Data
US 2019/0392755 A1 Dec. 26, 2019

Related U.S. Application Data
(60) Provisional application No. 62/458,775, filed on Feb. 14, 2017.

(51) Int. Cl.
*G09G 3/3225* (2016.01)

(52) U.S. Cl.
CPC ... *G09G 3/3225* (2013.01); *G09G 2300/0809* (2013.01); *G09G 2320/0233* (2013.01)

(58) Field of Classification Search
CPC ..... G09G 3/3225; G09G 2300/0809; G09G 2320/0233; G09G 3/2018
See application file for complete search history.

(56) References Cited

U.S. PATENT DOCUMENTS

| | | | |
|---|---|---|---|
| 2004/0263425 A1 | 12/2004 | Anzai et al. | |
| 2004/0263508 A1 | 12/2004 | Koyama et al. | |
| 2007/0126666 A1 | 6/2007 | Yamazaki et al. | |
| 2015/0070407 A1 | 3/2015 | Lee et al. | |
| 2015/0221637 A1* | 8/2015 | Kimura | G09G 3/3233 257/300 |

FOREIGN PATENT DOCUMENTS

CN 104575380 A 4/2015

OTHER PUBLICATIONS

International Search report for Application No. PCT/SG2018/050048 dated Apr. 14, 2018, 3 pages.
(Continued)

*Primary Examiner* — Rodney Amadiz

(57) ABSTRACT

Disclosed is a subpixel circuit 310 comprising: a first switching device 311 responsive to a digital periodic signal $V_P$ to provide a digital control signal $V_C$ relating to a digital data signal $V_D$, the digital periodic signal $V_P$ defining $2^N+1$ time slots within each frame cycle, where N is a predetermined integer. The digital data signal $V_D$ has a predeter-
(Continued)

mined value at a predetermined one of the $2^N+1$ time slots; and the subpixel circuit 310 further comprises a second switching device 312 responsive to the control signal Vc to drive an associated light emitting element 320.

14 Claims, 4 Drawing Sheets

(56) References Cited

OTHER PUBLICATIONS

Extended European Search Report with Written Opinion for Application No. 18754636.1 dated Jun. 19, 2020, 14 pages.
Bang et al., A Hybrid AMOLED Driver IC for Real-Time TFT Nonuniformity Compensation, IEEE Journal of Solid-State Circuits, Apr. 2016, pp. 966-978, vol. 51, No. 4.
Jang et al., A PDM-Based Digital Driving Technique Using Delta-Sigma Modulation for QVGA Full-Color AMOLED Display Applications, Journal of Display Technology, Jul. 2010, pp. 269-278, vol. 6, No. 7.
Li Zhang, et al., U.S. Appl. No. 16/477,095, filed Jul. 10, 2019, titled "Method of Forming a Multilayer Structure for a Pixelated Display and a Multilayer Structure for a Pixelated Display" (this U.S. application claims priority from U.S. Appl. No. 62/445,877—Method of forming CMOS integrated light emitting device array dated Jan. 13, 2017).
Ma, R., Active Matrix for OLED Displays, in Chen, J., Cranton, W. Fihn, M. (eds.) Handbook of Visual Display Technology, 2012, pp. 1223-1237.

* cited by examiner

SUBPIXEL CIRCUITRY FOR DRIVING AN ASSOCIATED LIGHT ELEMENT, AND METHOD, DISPLAY SYSTEM AND ELECTRONIC DEVICE RELATING TO SAME

CROSS REFERENCE TO RELATED APPLICATIONS

The present application is a national phase entry under 35 U.S.C. § 371 of International Application No. PCT/SG2018/050048 filed on Feb. 1, 2018, which claims priority from U.S. Provisional Patent Application No. 62/458,775, filed on Feb. 14, 2017, the disclosures of which are hereby incorporated herein by reference.

TECHNICAL FIELD

The present invention relates to a subpixel circuit, and a display and an electronic device having the same.

BACKGROUND

Modern flat display devices generally employ a matrix array of light emitting diodes or variants thereof. Performance of the display devices is dependent on a number of factors, one of which is the implementation of the pixel circuit. FIG. 1A illustrates a conventional subpixel circuit 110 for driving an associated light emitting diode 120. The subpixel circuit includes five transistors and two capacitors (i.e., a 5T2C implementation).

FIG. 1B illustrates a circuit block diagram of an electronic device 200 including a graphics processing unit (GPU) 210 and a conventional display system, which includes a row driver 220, a column driver 230, a display panel 240 and a plurality of digital-analogue converters (DACs) 250. The display panel 240 includes a matrix array of pixel elements 241, each including three subpixel circuits 110 and associated light emitting elements 120 of respective colours.

Operation of the electronic device 200 is largely analogue. Specifically, digital data generated by the GPU 210 is converted by the DACs 250 into analogue data, which subsequently drives the subpixel elements 240 to emit light. Such an arrangement has numerous drawbacks.

One drawback relates to non-uniformity of the resultant luminance. Since the driving transistor of each pixel element is biased in its saturation region, the driving current of each LED is very sensitive to variations in the driving voltage at the gate of the driving transistor. A slight variation in the driving voltage may be sufficient to cause a corresponding variation in driving current, resulting in a luminance error. This phenomenon is particularly pronounced in display devices of higher resolutions or pixel densities, where a drop in the driving voltage (i.e., a product of the driving current and the resistance) along the analogue data line may cause a significant luminance inconsistency between, for example, the first pixel and last pixels, causing non-uniform luminance. In addition to being sensitive to variations in the driving voltage, the resultant luminance is also known to be sensitive to temperature variations.

To compensate for the aforementioned problem of non-uniformity, a compensation circuit is provided for each pixel element (see FIG. 1A). However, the compensation circuit may complicate control operations of the display system, reducing the highest achievable pixel density and/or the aperture ratio.

Another drawback relates to power consumption. The driving transistor is biased in its saturation region, where the impedance is typically large. In addition, the DACs 250 at the column lines consume a substantial amount of power.

A document titled "a digital driving technique for an 8b QVGA AMOLED display using modulation" by Jang et al., published by Purdue University in January 2009, discloses a subpixel driver that includes two transistors and a capacitor. The subpixel driver receives a digital control signal generated using delta-sigma modulation. However, the use of delta-sigma modulation necessitates the adoption of a capacitor for holding a data signal at a pixel level, rendering the circuit complex and hardware intensive.

It is desirable to provide a sub-pixel circuit which addresses at least one of the drawbacks of the prior art and/or to provide the public with a useful choice.

SUMMARY

According to one aspect, there is provided a first switching device responsive to a digital periodic signal to provide a digital control signal relating to a digital data signal, the digital periodic signal defining $2^N+1$ time slots within each frame cycle, where N is a predetermined integer, the digital data signal having a predetermined value at a predetermined one of the $2^N+1$ time slots; and a second switching device responsive to the control signal to drive an associated light emitting element.

The described embodiment is particularly advantageous. Since the circuit is driven digitally at pixel levels, the circuit is substantially immune to non-ideal effects that are present in analogue systems, thereby achieving improved luminance uniformity across a display panel. There may also not be a need to use compensation circuits at the pixel level to compensate for luminance uniformity and higher pixel densities and higher aperture ratios are relatively easy to achieve. In a specific example, the first and second switching devices may be transistors which operate digitally as switching devices, and thus no DACs are needed. Furthermore, power dissipation only involves dynamic power loss in front-end digital signal processing and static driving power loss at the pixel level. As such, power dissipation is greatly reduced compared to analogue driven display systems.

Preferably, the predetermined time slot may be one of the first and last time slots. The first switching device may include a first terminal adapted to receive the digital data signal, a second terminal for providing the digital control signal, and a control terminal adapted to receive the digital periodic digital signal; and the second switching device may include a first terminal adapted to receive a supply voltage, a second terminal adapted to be connected electrically to a light emitting element, and a control terminal connected electrically to the second terminal of the first switching device.

In a specific embodiment, it is preferred that the subpixel circuit may comprise no capacitive element electrically connected between the switching devices.

Even more specifically, the subpixel circuit may not have any capacitive element.

Preferably, each of the switching devices may include a transistor. More preferably, each of the switching devices is configured to normally operate in a linear region thereof.

The subpixel circuit may be implemented as part of a display system, and the display system may comprise: a plurality of light emitting elements; a plurality of subpixel circuits as described above operatively associated with the light emitting elements; a coder unit operatively associated with the subpixel circuits and responsive to a first input signal to provide the digital data signal; and a selection unit operatively associated with the subpixel circuits and responsive to a second input signal to provide the digital periodic signal.

Each of the first and second input signal of the display system may be a digital input signal. The light emitting elements may include organic light emitting diodes (OLED).

The display system may be part of an electronic device, and in this respect, the electronic device may comprise a display system as discussed above; and a graphics processing unit operatively associated with the coder unit and the selection unit and configured to generate the first and second input signals. In this respect, the display system may be an OLED display.

According to another aspect, there is provided a control method for a subpixel circuit, comprising driving an associated light emitting element in response to a digital control signal, the control signal being related to a digital data signal and derived from a digital periodic signal, the digital periodic signal defining $2^N+1$ time slots within each frame cycle, where N is a predetermined integer, the digital data signal having a predetermined value at a predetermined one of the $2^N+1$ time slots.

Preferably, the predetermined time slot may be one of the first and last time slots.

According to another aspect, there is provided a subpixel circuit comprising a first transistor responsive to a digital periodic signal to provide a digital control signal relating to a digital data signal, and a second transistor responsive to the control signal to drive an associated light emitting element, with no capacitive element electrically connected between the first and second transistors. Specifically, the subpixel circuit may comprise no capacitive element.

It is envisaged that features relating to one aspect may be applicable to the other aspects.

BRIEF DESCRIPTION OF THE DRAWINGS

Example embodiments will now be described hereinafter with reference to the accompanying drawings, wherein like parts are denoted by like reference numerals. Among the drawings.

DETAILED DESCRIPTION

Figure 1A:
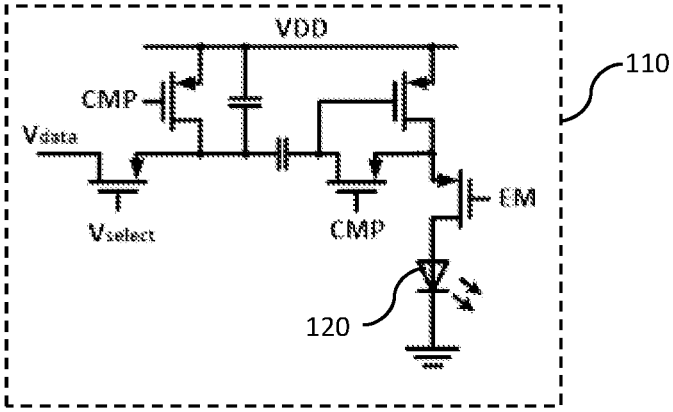
FIG. 1A illustrates a circuit diagram of a conventional subpixel circuit.
Figure 1B:
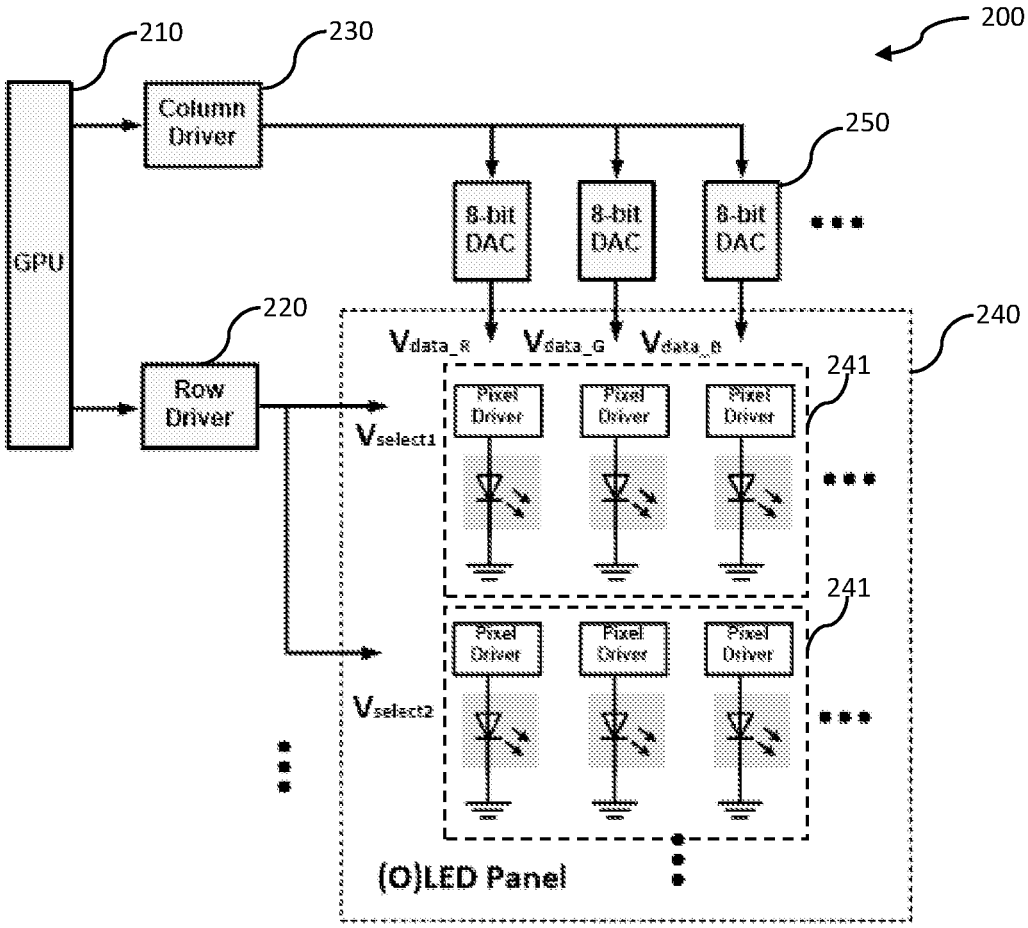
FIG. 1B illustrates a circuit block diagram of an electronic device employing an array of the conventional subpixel circuits depicted in FIG. 1A.
Figure 2A:
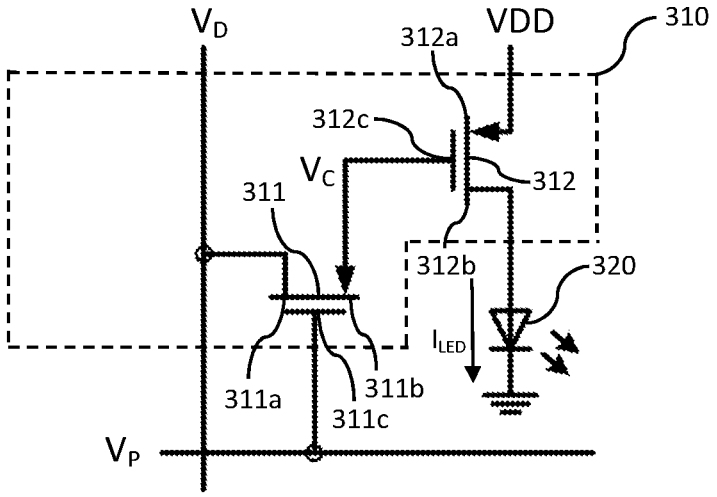
FIG. 2A illustrates a circuit diagram of a subpixel circuit according to an example embodiment of the present invention.

Referring to FIG. 2A, a subpixel circuit 310 (marked by the dashed line) according to an example embodiment of the present invention includes a first switching device 311 in the form of a first switch 311, and a second switching device 312 in the form of a second switch 312. It is to be noted that the switching devices 311, 312 may, in other embodiments, be implemented by way of any other active and/or passive components and/or more switches.

The first switch 311, functioning as a gating switch, is responsive to a digital periodic signal $V_P$ to provide a digital control signal Vc relating to a digital data signal $V_D$. In this embodiment, the signals $V_C$, $V_D$, $V_P$ are binary signals each having two logic states, namely "1" (ON) and "0" (OFF). The digital periodic signal $V_P$ defines $2^N+1$ time slots within each frame cycle, where N is a predetermined integer. The digital control signal $V_C$ has a predetermined value at a predetermined one of the $2^N+1$ time slots.

In particular, the first switch 311 includes a first terminal 311*a* receiving the digital data signal $V_D$, a second terminal 311*b* providing the digital control signal $V_C$, and a control terminal 311*c* receiving the digital periodic signal $V_P$. The first switch 311 thus provides the digital control signal $V_C$ from the digital data signal $V_D$ based on the digital periodic signal $V_C$.

The second switch 312, functioning as a driving switch, is responsive to the digital control signal $V_C$ provided by the first switch 311 to drive an associated light emitting element 320. In particular, the second switch 312 includes a first terminal 312*a* receiving a supply voltage VDD, a second terminal 312*b* connected electrically to the light emitting element 320, and a control terminal 312*c* connected electrically to the second terminal 311*b* of the first switch 311 for receiving the digital control signal $V_C$ from the first switch 311.

The light emitting element 320 in this embodiment is a light emitting diode (LED) through which a driving current $I_{LED}$ passes. Specifically, the second switch 312 closes to allow the supply voltage VDD to pass through the light emitting element 320 based on the received digital control signal $V_C$, resulting in the passage of the driving current $I_{LED}$ through the light emitting element 320.

The subpixel circuit 310 and the associated light emitting element 320 together form a subpixel. It is worth noting that the subpixel circuit includes no capacitive element in this embodiment.

In this example, each of the switches 311, 312 includes a metal-oxide-semiconductor field-effect transistor (MOSFET) transistor and operates in a linear region thereof. It is to be appreciated that, in other embodiments, each of the switches 311, 312 may include a suitable transistor or the like of any other type, such as a bipolar junction transistor or a gallium nitride power switch.

Figure 3:
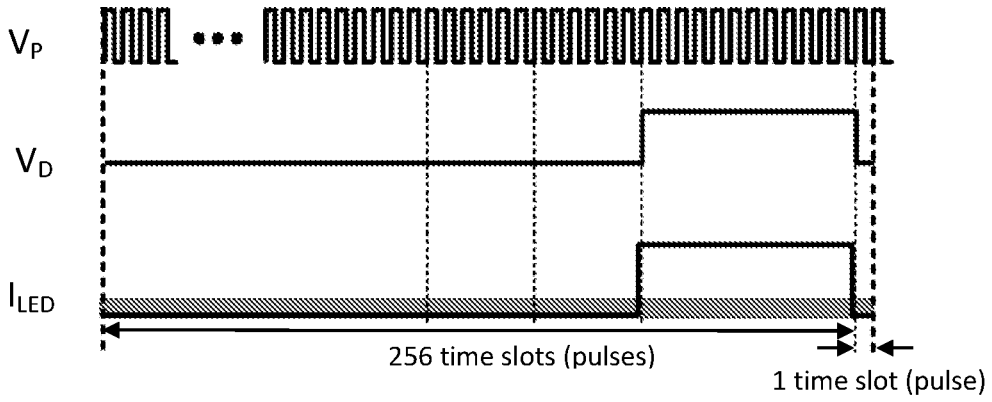
FIG. 3 illustrates a timing diagram of the subpixel circuit of FIG. 2A.

FIG. 3 shows an example timing diagram of the digital periodic signal $V_P$, the digital data signal $V_D$ and the driving current $I_{LED}$. The digital periodic signal is shown to oscillate or alternate between the two logic states with a duty cycle of 50%. Due to the periodic nature of the digital periodic signal $V_P$, the digital control signal $V_C$ has a signal waveform similar to that of the digital data signal $V_D$. The digital data signal $V_D$ and the corresponding digital control signal $V_C$ represents a sequence of binary codes of "0" (OFF) and "1" (ON), represented by high and low voltages, respectively.

In this embodiment, N is 8 (i.e., 8-bit greyscale control) such that the digital periodic signal $V_P$ has $2^8+1$ (i.e., 257) time slots in each frame cycle. In such a configuration, the subpixel circuit 310 is activated or scanned 257 times during each frame cycle for controlling the light emitting element 320 based on the digital data signal $V_D$ received by the subpixel circuit 310. The predetermined time slot is the last time one of the 257 time slots in this embodiment, and may be the first one of the 257 time slots in other embodiments. The digital data signal $V_D$ and hence the digital control signal $V_C$ have a predetermined logic state of "0" (OFF) at the predetermined time slot. Such a configuration ensures that the signals $V_D$, $V_C$ transition from "1" to "0" at the predetermined time slot of each frame cycle, thereby resetting the subpixel circuit 310 and dimming the light emitting element 320. In this manner, where a first logic state transition from "0" to "1" occurs during any one of the first 256 time slots, a second logic state transition from "1" to "0" occurs at the last (i.e., the $257^{th}$) time slot to reset the subpixel circuit 310 for the next frame cycle. That is, two logic state transitions occur during a frame cycle where the digital data signal $V_D$ represent a greyscale or brightness value of non-zero for that frame cycle.

The signal representation of the driving current $I_{LED}$ in the timing diagram is similar to that of the data signal $V_D$. A shaded area can be seen in the signal representation of the driving current $I_{LED}$. The shaded area represents an average or overall luminance level of light emitted by the light emitting element 320 during the frame cycle. The shaded area is proportional to the number of time slots within the frame cycle at which the digital data signal $V_D$ has a logic state of "1" (ON).

Figure 2B:
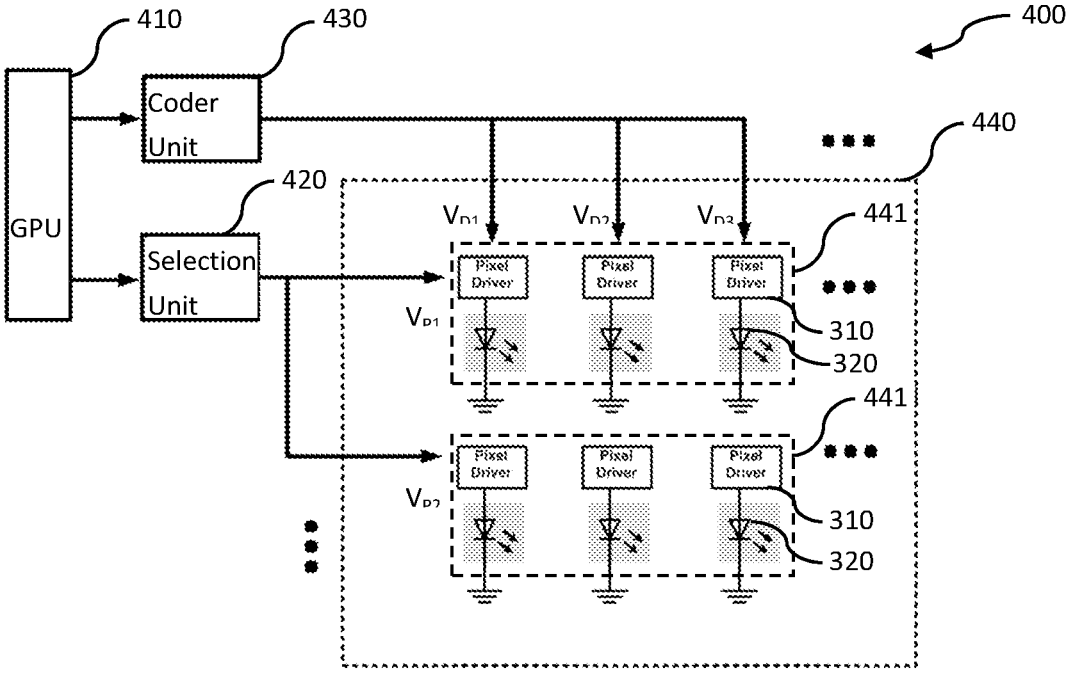
FIG. 2B illustrates a circuit block diagram of an electronic device employing an array of the subpixel circuits depicted in FIG. 2A.

FIG. 2B discloses an electronic device 400 including a graphics processing unit 410 (GPU) and a display system. The display system includes a selection unit 420, a coder unit 430 and a display panel 440.

The GPU 410 is configured to generate first and second input signals, which are digital signals in this embodiment and may be analogue signals in other embodiments. The coder unit 430 is responsive to the first input signal to generate a plurality of digital data signals $V_{D1}$-$V_{D3}$ corresponding to respective colours for provision to the display panel 440. The selection unit 420 is responsive to the second input signal to generate a plurality of digital periodic signals $V_{P1}$, $V_{P2}$ for provision to the display panel 440 in association with the digital data signals $V_{D1}$-$V_{D3}$. The coder unit 430 in this embodiment embodies a digital circuit including digital components, such as flip-flops and combinational logics. In contrast with the DACs of the prior art, the coder unit 430 has lower power dissipation, consumes zero or low static power, and is uses relatively low dynamic power.

The display panels 440 is an organic light emitting diode (OLED) panel including an array of pixel elements 341 arranged in a matrix of rows and columns. Each pixel element 341 consists of three subpixel elements 310 corresponding to red, green and blue, respectively. Each row of the pixel element 341 sequentially receives a corresponding one of the digital periodic signals $V_{p1}$, $V_{p2}$. Each of the subpixel elements 310 has the configuration depicted in FIG. 2A, including a subpixel circuit 310 and a light emitting element 320 of the corresponding colour as described hereinabove, and receives a corresponding one of the digital data signals $V_{D1}$-$V_{D3}$ upon receiving or activation by the corresponding one of the digital periodic signals $V_{p1}$, $V_{p2}$.

Figure 4:
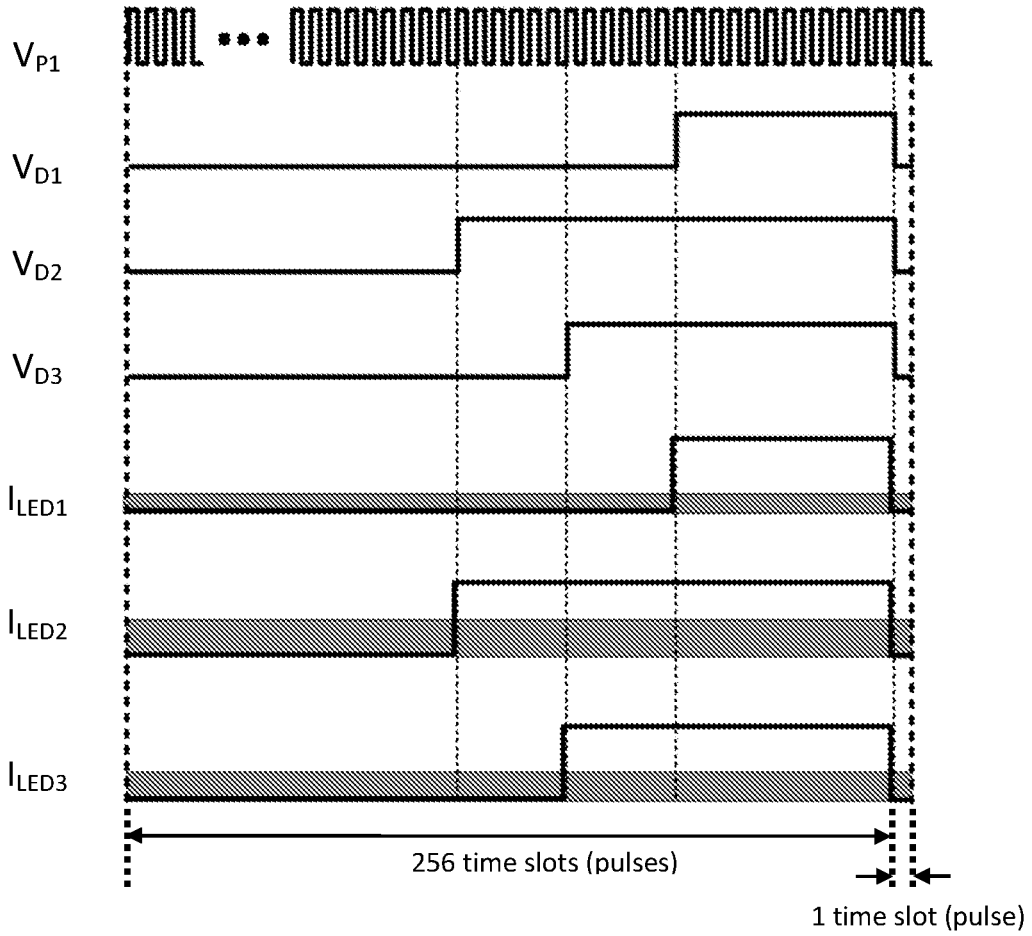
FIG. 4 illustrates a timing diagram of a pixel element of the electronic device of FIG. 2B.

FIG. 4 illustrates a timing diagram of one of the pixel elements 341 in the first row during a frame cycle. Each subpixel circuit 310 of said one of the pixel elements 341 receives the periodic digital signal $V_{P1}$ and the corresponding one of the digital data signals $V_{D1}$-$V_{D3}$, and drives the corresponding light emitting element 320 to emit light of the respective colour at the respective greyscale or brightness level in the manner described hereinabove. Light emitted by said one of the pixel elements 441 thus has red, green and blue components at higher, lower and intermediate overall luminance levels, respectively.

A suitable existing subpixel circuit may be configured to perform a control method according to an embodiment of the present invention, comprising driving an associated light emitting element in response to a digital control signal, the control signal being related to a digital data signal and derived from a digital periodic signal, the digital periodic signal defining $2^N$+1 time slots within each frame cycle, where N is a predetermined integer, the digital data signal having a predetermined value at a predetermined one of the $2^N$+1 time slots. Operation of the existing subpixel circuit is similar to that of the subpixel circuit described hereinabove in relation to FIGS. 1 to 4, and will not be described herein for the sake of brevity.

The subpixel circuit 310 and the display system of the present invention have numerous advantages. Firstly, because the system is driven digitally at both system and pixel levels, the system is substantially immune to non-ideal effects, such as voltage drop due to wire resistance, transistor variations due to process and temperature etc., that are present in analogue systems, thereby achieving improved luminance uniformity across the display panel. Secondly, since no compensation circuits are required at the pixel level to compensate for luminance uniformity, higher pixel densities and higher aperture ratios are relatively easy to achieve. Thirdly, since all transistors operate digitally as switches, no DACs are needed. Also, without the DAC (which is "power hungry") and with low impedance (since the transistors driving each pixel are biased in the linear regions) ultra-low power dissipation may be achieved. Furthermore, power dissipation only involves dynamic power loss in front-end digital signal processing and static driving power loss at the pixel level. As such, power dissipation is greatly reduced compared to analogue driven display systems.

Having now fully described the invention, it should be apparent to one of ordinary skill in the art that many modifications can be made hereto without departing from the scope as claimed.

The invention claimed is:

1. A subpixel circuit comprising:

a first switching device configured to:

receive a digital periodic signal, the digital periodic signal defining $2^N$+1 time slots within each frame cycle, where N is a predetermined integer;

receive a digital data signal, the digital data signal comprising a sequence of binary logic states of "0" and "1", and having a predetermined state at a predetermined one of the $2^N$+1 time slots; and provide a digital control signal from the digital data signal, based on the digital periodic signal; and a second switching device responsive to the digital control signal to drive an associated light emitting element, wherein an average luminance level of light emitted by the associated light emitting element during a frame cycle is proportional to a number of time slots within the frame cycle at which the digital data signal has the logic state of "1".

2. The subpixel circuit of claim 1, wherein the predetermined time slot is one of the first and last time slots.

3. The subpixel circuit of claim 1, wherein:

the first switching device includes a first terminal adapted to receive the digital data signal, a second terminal for providing the digital control signal, and a control terminal adapted to receive the digital periodic digital signal; and the second switching device includes a first terminal adapted to receive a supply voltage, a second terminal adapted to be connected electrically to a light emitting element, and a control terminal connected electrically to the second terminal of the first switching device.

4. The subpixel circuit of claim 1, comprising no capacitive element electrically connected between the switching devices.

5. The subpixel circuit of claim 4, comprising no capacitive element.

6. The subpixel circuit of claim 1, wherein each of the switching devices includes a transistor.

7. The subpixel circuit of claim 6, wherein each of the switching devices is configured to normally operate in a linear region thereof.

8. A display system comprising:

a plurality of light emitting elements;

a plurality of subpixel circuits of claim 1 operatively associated with the light emitting elements;

a coder unit operatively associated with the subpixel circuits and responsive to a first input signal to provide the digital data signal; and a selection unit operatively associated with the subpixel circuits and responsive to a second input signal to provide the digital periodic signal.

9. The display system of claim 8, wherein each of the first and second input signal is a digital input signal.

10. The display system of claim 8, wherein the light emitting elements include organic light emitting diodes (OLED).

11. An electronic device comprising:

a display system of claim 8; and a graphics processing unit operatively associated with the coder unit and the selection unit and configured to generate the first and second input signals.

12. The electronic device of claim 11, wherein the display system comprises an OLED display.

13. A control method for a subpixel circuit, comprising driving an associated light emitting element in response to a digital control signal, the digital control signal being related to a digital data signal and derived from a digital periodic signal, the digital periodic signal defining $2^N+1$ time slots within each frame cycle, where N is a predetermined integer, the digital data signal comprises a sequence of binary logic states of "0" and "1", and having a predetermined state at a predetermined one of the $2^N+1$ time slots, wherein an average luminance level of light emitted by the associated light emitting element during a frame cycle is proportional to a number of time slots within the frame cycle at which the digital data signal has the logic state of "1".

14. The control method of claim 13, wherein the predetermined time slot is one of the first and last time slots.

* * * * *